United States Patent [19]

Monma

[11] Patent Number: 4,936,232

[45] Date of Patent: Jun. 26, 1990

[54] EMBROIDERING SYSTEM

[75] Inventor: Tadahiro Monma, Tokyo, Japan

[73] Assignee: Janome Sewing Machine Industry Co., Ltd., Tokyo, Japan

[21] Appl. No.: 334,889

[22] Filed: Apr. 7, 1989

[30] Foreign Application Priority Data

Apr. 8, 1988 [JP] Japan ..... 63-85135

[51] Int. Cl.[5] ..... D05C 9/04; D08B 21/00

[52] U.S. Cl. ..... 112/103; 112/121.12; 112/155

[58] Field of Search ..... 112/103, 121.12, 102, 112/121.11, 78, 86, 155, 98; 364/470

[56] References Cited

U.S. PATENT DOCUMENTS

| | | | |
|---|---|---|---|
| 4,369,722 | 1/1983 | Nishida et al. | 112/103 |
| 4,479,446 | 10/1984 | Johnson et al. | 112/121.12 |
| 4,763,586 | 8/1988 | Takenoya et al. | 112/121.12 X |
| 4,768,450 | 9/1988 | Kato et al. | 112/121.12 |
| 4,823,714 | 4/1989 | Yokoe et al. | 112/121.12 X |

*Primary Examiner*—Peter Nerbun

*Attorney, Agent, or Firm*—Dann, Dorfman, Herrell and Skillman

[57] ABSTRACT

Disclosed is an embroidering system comprising several embroidering machines of known type which will be operated under the operation mode peculiar thereto, and a control unit, to which one or more of the embroidering machines can be connected by a coupling means, adapted to electronically control operation of the embroidering machines connected thereto. When an embroidering machine is electrically connected to the control unit, a signal representing its operation mode is generated from the embroidering machine. The control unit includes a discriminator operated responsive to the signal to discriminate the operation mode of the embroidering machine now electrically connected, whereupon the control unti will be operated to control operation of said embroidering machine in such manner as to conform to the operation mode thereof.

2 Claims, 6 Drawing Sheets

EMBROIDERING SYSTEM

BACKGROUND OF THE INVENTION

This invention relates to an embroidering system comprising one or more of embroidering machines connectable to a single control unit adapted to electronically control operation of the embroidering machines.

Such systematic arrangement for producing embroidery stitches on a fabric has been recently developed along with electronization of ordinary sewing machines. The control unit includes a memory storing data necessary for producing a number of patterns of embroidery stitches on the fabric which is supported and stretched within an embroidery frame mounted on the embroidering machine. One sequential set of the data can be selected by the operator to be read out from the memory of the control unit and transferred to the embroidering machine for producing the selected pattern of embroidery stitches.

There are provided different types of the embroidering machines to meet various uses that could be required by the users. The respective embroidering machines can only be operated under their inherent mode of operation. Therefore, when several embroidering machines having different modes of operation are used, several control units adapted to control the machines respectively should have been employed. That is, the control unit has been provided for exclusive use in connection with a specific type of the embroidering machine and has no compatibility with other types. Such look of compatability makes it financially difficult for a general domestic user to have the use of several different types of embroidering machines.

In order to obviate such disadvantages, there has been proposed a control unit compatible to several embroidering machines of different types all connectable to the control unit. This control unit includes switch means which is manually operated to select one of the embroidering machines to be energized so that data required to operate the selected one of the embroidering machines will be read out and transferred thereto. With this arrangement, however, it would often happen that the switch be misoperated to read out erroneous data, resulting in that the embroidering machine to which the erroneous data has been input would be driven out of order or in some case destroyed.

SUMMARY OF THE INVENTION

It is therefore an object of this invention to provide a novel embroidering system which could obviate disadvantages of the prior art.

Another object of this invention is to provide a novel embroidering system comprising a single control unit which will automatically discriminate to select an embroidering machine to be now operated so that the control unit can properly control the said embroidering machine with the control data which will be prepared in conformity to the operation mode thereof.

According to an aspect of this invention there is provided an embroidering system comprising one or more of an embroidering machine having a vertically reciprocating needle carrying an upper thread, a loop taker means carrying a lower thread and operated in synchronism with the needle to interlock the upper thread with the lower thread to thereby form a stitch, and means for shifting a fabric in relation to the needle to thereby shift a needle dropping point, said embroidering machine being operated under an operation mode peculiar thereto; and a control unit, to which said embroidering machine is connectable by electric coupling means, adapted to control operation of said embroidering machine. Further, said embroidering machine includes means for generating a signal representing the operation mode thereof when it is electrically connected to said control unit; and said control unit including means operated responsive to said signal to discriminate that said embroidering machine is now electrically connected to said control unit, whereby said control unit is operated to control operation of said embroidering machine in such manner as to conform to the operation mode thereof.

This system may be suitably employed when a plurality of emboidering machines having different operation modes are to be controlled by a single control unit.

BRIEF DESCRIPTION OF DRAWINGS

Further objects and advantages of this invention can be fully understood from the following detailed description when read in conjunction with the accompanying drawings in which.

DESCRIPTION OF PREFERRED EMBODIMENTS

Figure 1:
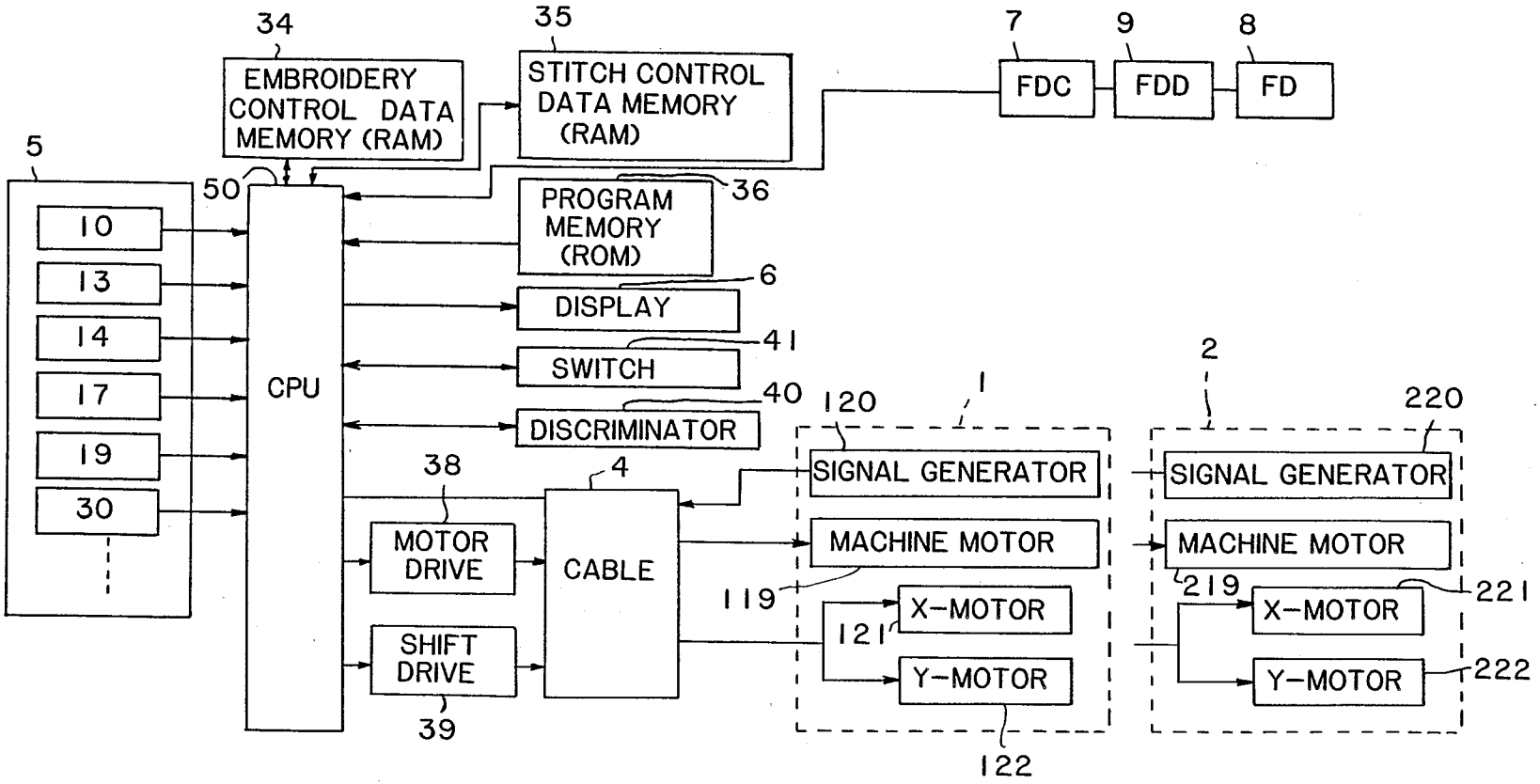
FIG. 1 is a block diagram illustrating an embroidering system embodying the invention.
Figure 2:
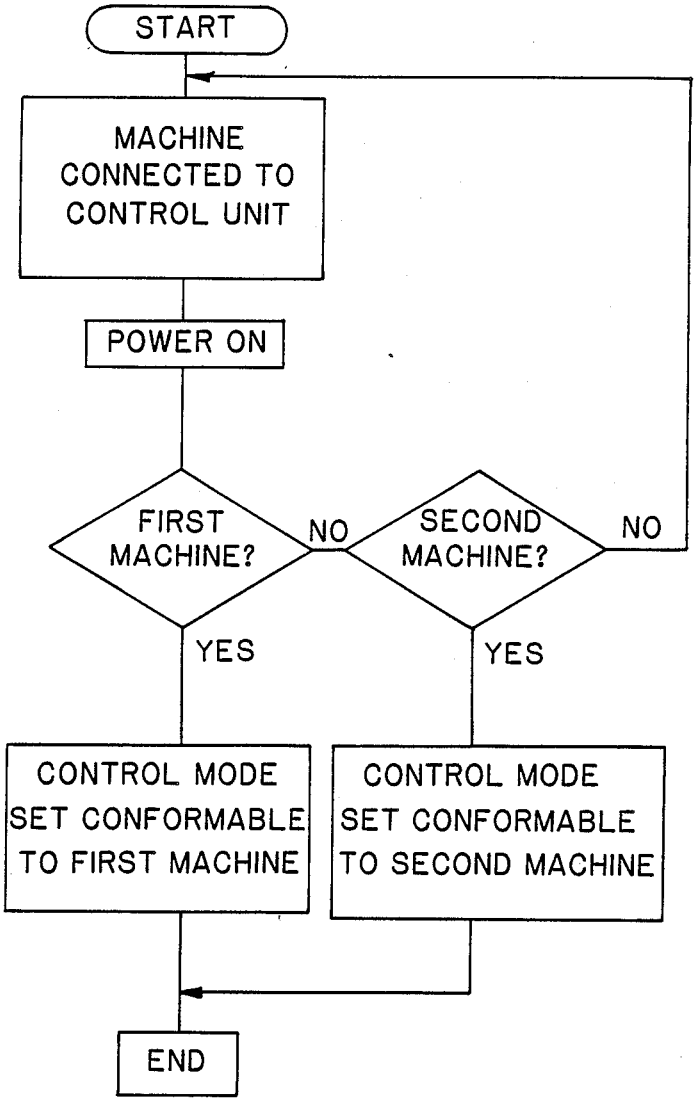
FIG. 2 is a flow chart illustrating control operation of the system.
Figures 3A, 3B, 3C:
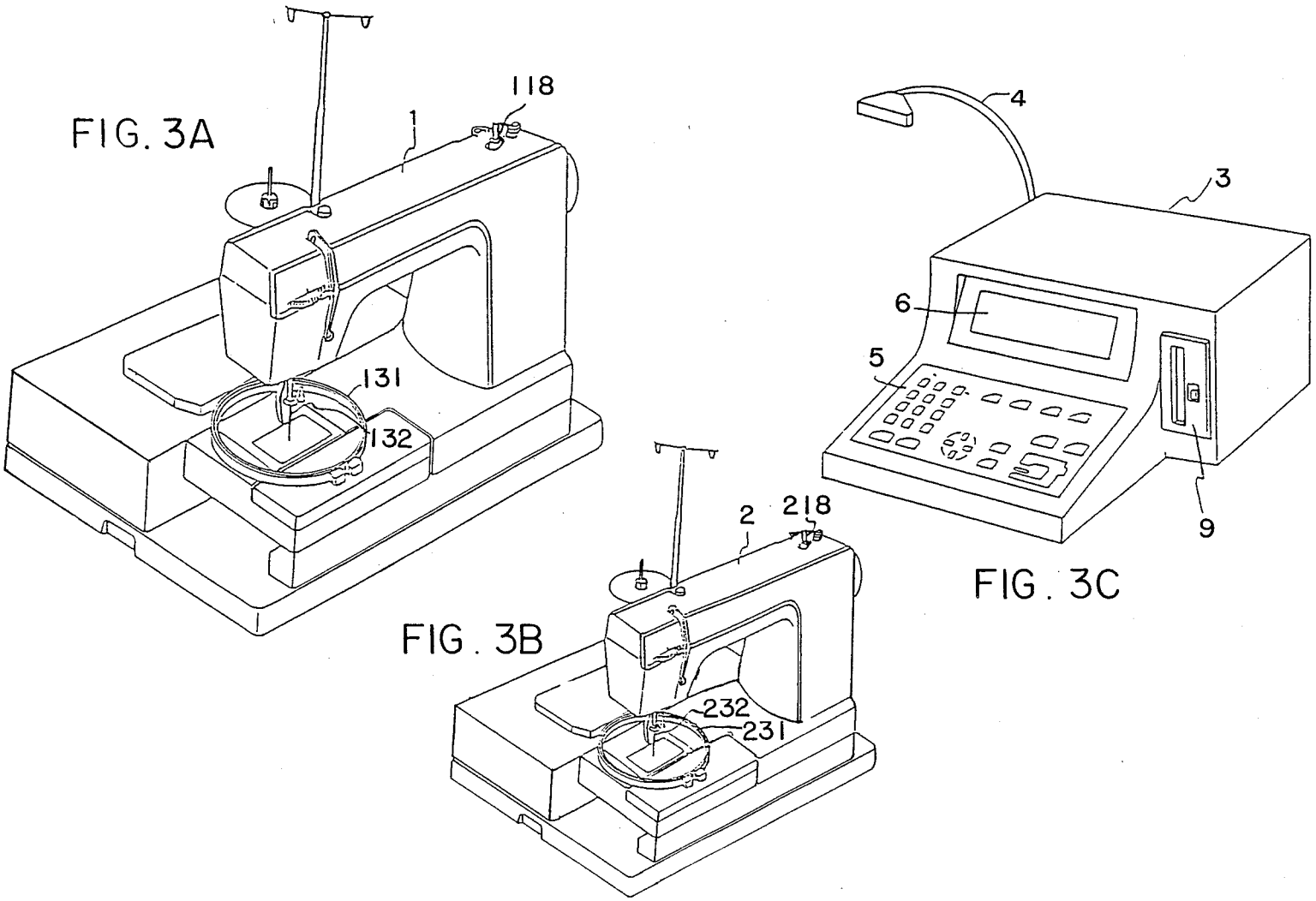
FIGS. 3A–3B are oblique views showing instruments constituting the system, which comprises a control unit and first and second embroidering machines each connectable to the control unit.

Reference should now be made to FIGS. 1 through 5 illustrating an embroidering system in accordance with an embodiment of the invention. In this embodiment, the system comprises in principle a first embroidering machine 1, a second embroidering machine 2 and a single control unit 3 to which a selective one of the first and second embroidering machines 1, 2 may be electrically connected by means of a coupling cable 4, as shown in FIG. 3. Socket or plug means for receiving the connecting end of the cable 4 are provided at the rear panel of the first and second embroidering machine 1, 2 but not shown in the drawing.

The first embroidering machine 1 is, as shown, of relatively large scale and particularly adapted to produce large-sized patterns of embroidery stitches. As is well known in the art, it includes an embroidery frame 131 of a larger diameter for supporting and stretching a fabric (not shown) and a vertically reciprocating needle 132 cooperated with a loop-taker means (not shown) to produce a stitch on the fabric in an area defined within the frame 131. Whereas, the second embroidering machine 2 is prepared for relatively small-sized patterns of embroidery stitches and similarly includes an embroidery frame 231 and a needle 232. These embroidering machines 1, 2 have in general construction that is well known as for streight stitching sewing machines but will not include fabric feeding means consisting of a feed dog mounted below the machine bed and a presser foot elongated substantially in parallel with the needle. Instead, with the embroidering machines 1, 2, the frames 131, 231 can be driven in two perpendicular directions along a horizontal plane for shifting the embroidery frame 131, 231 and accordingly a needle dropping point on the fabric.

The control unit 3 will control and command the operation performed by the embroidering machines 1, 2. On a housing of the control unit 3 there are provided a keyboard section 5 to be manually operated by the operator to select operational modes, and a liquid crystal display (LCD) 6 for representing information such as a character or shape of the selected character of the embroidery pattern to be stitched. The control unit 3 includes a floppy disc controller (FDC) 7 connected between a microcomputer or central processing unit (CPU) 50 and a floppy disc drive (FDD) 9. Embroidery control data for respectively producing a plurality of stitch patterns are in advance stored on both storage areas of a floppy disc (FD) 8. Each set of embroidery stitch data includes pattern data for determining a general shape of the pattern, display data comprising dot matrix data for representing the selected pattern on LCD 6 and peripheral frame data for determining a size of the selected pattern to be actually produced on the fabric. When FD 8 is inserted into FDD 9, the data in the former will be read out by the latter and transferred to a designated register in FDC 7 which is in turn processed in response to a command sent from CPU 50.

Figure 4:
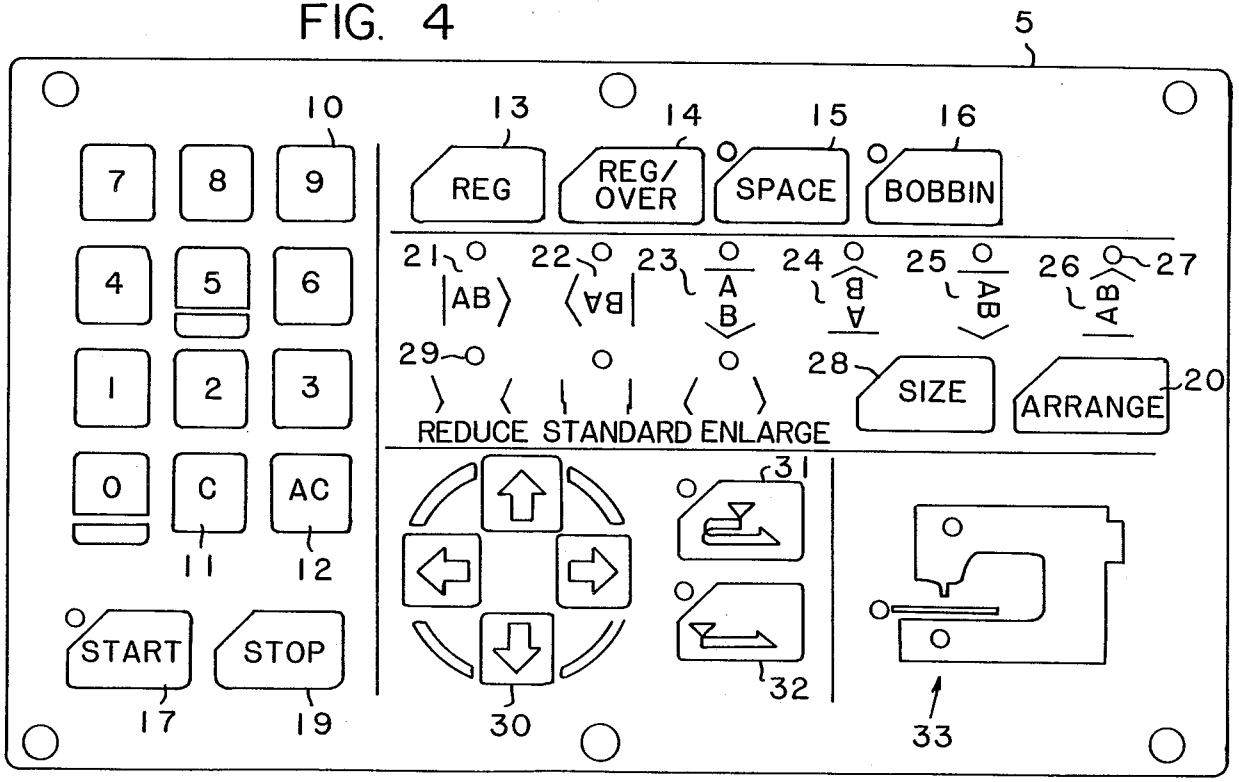
FIG. 4 is a diagrammatic view illustrating arrangement of a keyboard section, a part of the control unit.

Arrangement of the keyboard section 5 of the control unit 3 is shown in FIG. 4. Ten keys 10 are manipulated to select a desired one of stitch patterns which typically consists of alphabetical characters by designation of a corresponding pattern number. A clear key (C) 11 is depressed for clearance of data input by previous operation of the figure keys 10. Manipulation of an all-clear key (AC) 12 will clear all of the input data and return the needle to the original position in the embroidery frame 131, 231. To the figure "5" and "0" keys are assigned respectively additional functions to step-wise move forward and backward the frame 31, 131 when the machine 1, 2 is at a standstill during stitching operation.

A register key 13 is depressed after selection of one desired pattern number to register the said pattern number. A register complete key 14 will be depressed after all of the pattern numbers constituting a series of the characters to be stitched has been input, whereupon corresponding pattern data may be sequentially read out from FD 8. A predetermined space between two adjacent characters in the embroidery stitch pattern is preset but may optionally be changed by operation of the figure keys 10 to designate the space, followed by depression of a space-set key 15. Such manual-spacing mode will continue until AC key 12 is depressed. A bobbin key 16 is operated when a lower thread (not shown) is to be wound around a bobbin (not shown) fitted on an upstanding shaft 118, 218 of the embroidering machine 1, 2, in a known manner. Depression of this key will set the embroidering machine to a bobbin mode wherein a main drive shaft (not shown) is rotated by subsequent operation of a start key 17, while the embroidering frame 131, 231 being kept at a standstill. Thus, it becomes possible to set the lower thread around the bobbin. Five-step adjustment of the revolution of the main drive shaft during the bobbin mode may be achieved by manipulation of a selective one of the figure "1" to "5" keys 10. Operation of a stop key 19 will stop rotation of the main drive shaft and clear the bobbin mode.

Character arrangement in the embroidery pattern to be stitched may be selected from predetermined several arrangements which are diagrammatically shown on the keyboard section 5 as for an example of the pattern consisting of characters "A" and "B". In the illustrated example, there are preset seven typical pattern arrangements 21 to 29. By repeated depression of an arrangement-select key 20, lightening of indexes or light-emitting diodes (LED) 27 accompanying the respective patterns 21 to 26 will be changed one after another, whereupon a desired one of the patterns can be selected. The selected pattern whose LED 27 is lightened is duly registered in the memory means. It will be convenient that the first pattern arrangement 21, which will be usual in most cases, be automatically selected when the embroidering machines 1, 2 is first energized.

The size of a character in the embroidery pattern to be stitched is determined by operation of a size-set key 28. A desired one of reduced size, standard size and enlarged size can be selected by repeated depression of the size-set key 28, which is represented by an accompanying LED 29 with lightening. When the machines 1,2 is first energized, the standard size will be automatically selected so that a character pattern is stitched in a size determined by the peripheral frame data included in its embroidery control data.

4-way control keys 30 will be used for stepwise shifting the embroidery frame 131, 231. A pair of keys 31 and 32 are provided for selecting a starting position of the needle. There are also provided warning lamps or indicators referred to in general by a numeral 33. These arrangement are not a part of the invention and therefore detailed description thereof could be omitted.

After a desired set of characters have been input by depression of the key 13 or 14, the start key 17 is depressed so that the embroidering machine 1, 2 becomes operative and ready to produce the embroidery stitches. The machine operation can be stopped by the stop key 19.

With further reference to the block diagram in FIG. 1, the embroidery control data inherent to the selected character will be read out from FD 8 and transferred through FDC 7 and CPU 50 to a first RAM (random access memory) 34. The embroidery control data comprises, as described before, the pattern data determining the outer shape of the character which consists essentially of a number of typical needle dropping points on the periphery, the peripheral size data determining the character size and the display data. The remaining needle dropping points in the character, that is other than the typical ones governed by the pattern data, will be determined and controlled by stitch control data, which is programmed by a read only memory (ROM) 36 and stored in a second RAM 35 through CPU 50.

A motor driving circuit 38 is connected to CPU 50 to drive under control a motor 119, 219 mounted in the embroidering machine 1, 2 when coupled to the control unit 3 by means of the cable 4. Another driving circuit 39 is also connected to CPU 50 to drive a X-direction motor 121, 221 and/or a Y-direction motor 122, 222, thereby shifting the embroidery frame 131, 231 of the machine 1, 2 when coupled to the control unit 3. These driving circuits 38, 39 will be controlled responsive to the embroidery control data and the stitch control data respectively supplied from RAM 34 and RAM 35 through CPU 50.

The embroidering machine 1, 2 further includes a signal generator 120, 220 for generating a signal representing a mode of operation peculiar thereto. The operation mode signal of the embroidering machine 1, 2 that is connected to the control unit 3 through the cable 4 and now energized is transmitted to CPU 50, and then to a discriminator 40. The discriminator 40 is operated in response to the operation mode signal to discriminate which machine is now electrically connected to the control unit 3 and send a resultant discriminating signal back to CPU 50. CPU 50 includes control circuits which will be adapted to control the embroidering machines 1, 2 operatable under different operation modes and automatically switched to a suitable operational condition responsive to a control signal output from a switching circuit 41 in correspondence to the discriminating signal. The control circuits in CPU 50 will thus control the embroidering machine operation under specific conditions.

In FIG. 1, only several means encircled by dotted lines are mounted in the embroidering machine 1, 2 and all remaining means are arranged in the control unit 3.

With the above arrangement and construction, operation of the system will be described in reference to FIG. 2.

Let me suppose that the first embroidering machine 1 is connected to the control unit 3 via the coupling cable 4. When a power supply switch (not shown) of the machine 1 is turned on, the signal generator 120 will be operated to generate its operation mode signal to CPU 50 of the control unit 3. This operation mode signal of the first machine 1 is recognized by the discriminator 40 which in turn causes the switching circuit 41 to output the corresponding control signal to CPU 50. The embroidering machine 1 will now be ready for stitching operation under control which is governed by the control circuits in CPU 50.

The control of CPU 50 performed in conformity to the operation mode will be best understood when it is assumed that the second embroidering machine 2 having a smaller embroidery frame 231 is connected to the control unit 3. In this case, the control circuits of CPU 50 will be switched to a control mode under which the second machine 2 is controlled in such manner that a stitching area larger than that defined by the embroidery frame 231 will not be permitted even when the keyboard section 4 of the control unit 3 has been operated to that effect. For example, the character size and the number of characters to be sequentially stitched will be limited in conformity to the stitchable area defined by the relatively smaller frame 231. The control unit 3 may be equipped with warning means such as buzzers and lamps which is actuated when the embroidering machine should be errouneously connected to the control unit 3.

Figure 5:
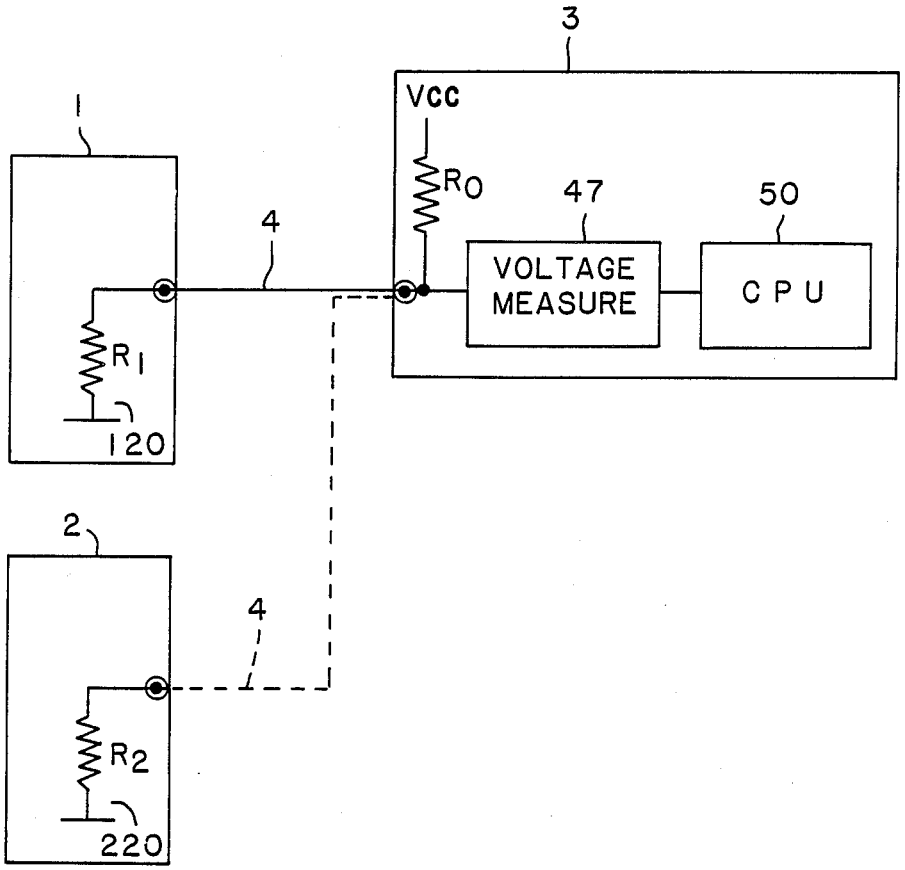
FIG. 5 is a block diagram illustrating arrangement of means for discriminating which machine is now connected to the control unit.

Arrangement of the operation mode signal generator 120, 220 and the signal discriminator 40 can be seen in FIG. 5 by way of example. More particularly, the mode signal generators 120, 220 comprise resistors $R_1$, $R_2$ of different resistance value, respectively, one of which is connectable to the control unit 3 via the cable 4. In the control unit 3, a voltage measuring device 47 is provided as the signal discriminator 40, which is connected to CPU 50 and a power supply Vcc through a reference resistor $R_0$. With this arrangement, when the first embroidering machine 1 is connected to the control unit 3 and then energized, the device 47 will measure a voltage value $V_1$ that is determined by the following equation based on a voltage dividing ratio of the reference resister $R_0$ and the resister $R_1$:

$$V_1 = \frac{V_{cc} \times R_1}{R_o + R_1}$$

When this voltage value is obtained in the device 47, it discriminates that the first embroidering machine 1 is now connected to the control unit 3.

When, in turn, the second embroidering machine 2 is connected and a power is supplied thereto, another voltage value $V_2$ is obtained by the following equation:

$$V_2 = \frac{V_{cc} \times R_2}{R_o + R_2}$$

which will be a criterion for discriminating that the second machine 2 is now connected.

Figure 6:
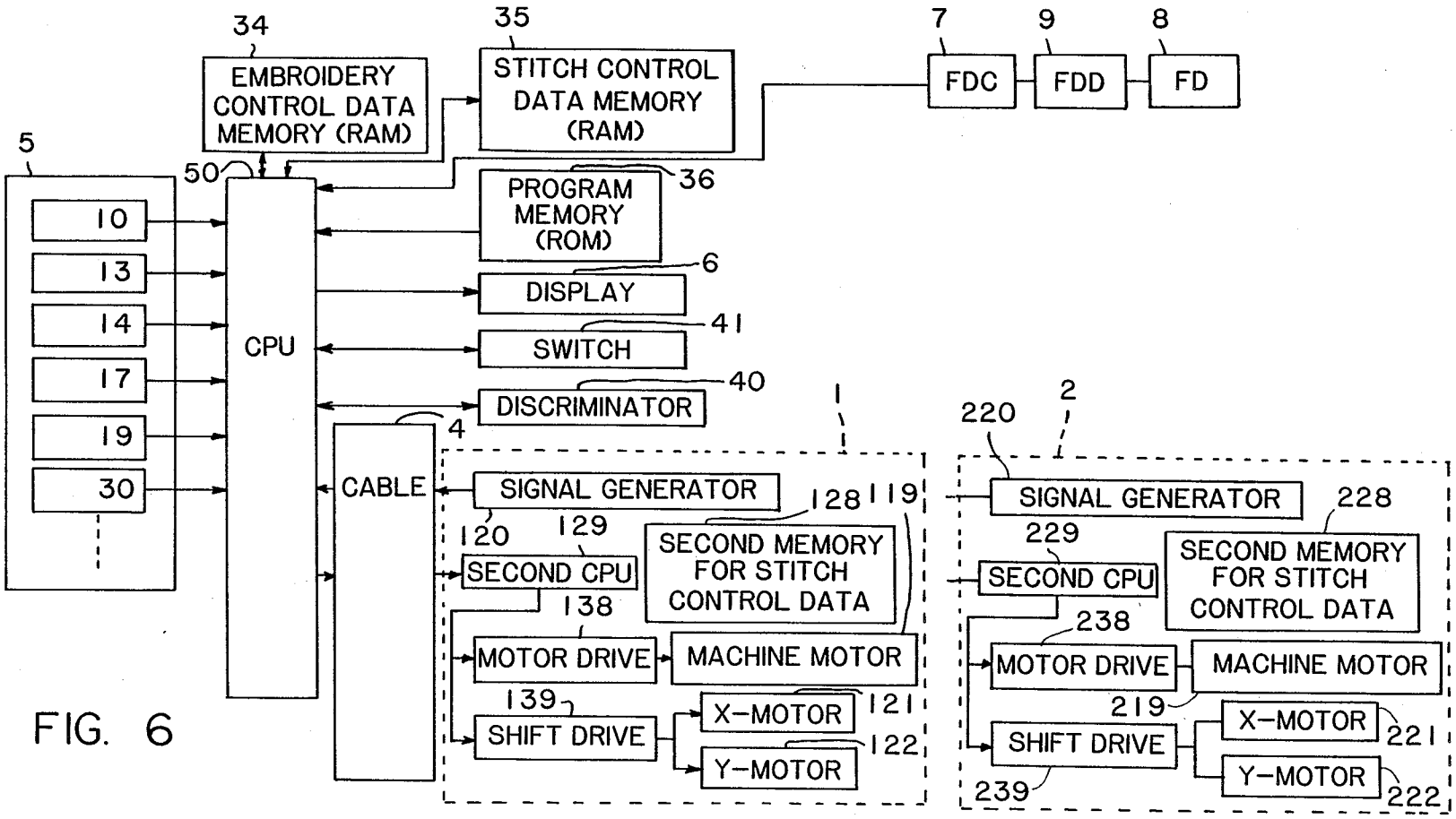
FIG. 6 is a block diagram illustrating another embodiment of the invention.

FIG. 6 is a block diagram illustrating a modified embodiment in which means or members substantially identical to those in the aforementioned embodiment are accompanied by the identical reference numerals. In this modified example, the embroidering machine 1, 2 includes an additional memory 128, 228 storing the stitch control data which will be transferred from RAM 2 through CPU 50, the coupling cable 4 and a second CPU 129, 229. The embroidering machine 1, 2 also includes a driving circuit 138, 238 for driving the machine motor 119, 219 and another driving circuit 139, 239 for driving the X-direction motor 121, 221 and/or the Y-direction motor 122, 222 to thereby shift the embroidery frame 131, 231. The second CPU 129, 229 will be operated responsive to the stitch control data stored in the additional memory 128, 228 to control these driving circuits 138, 139; and 238, 239. Thus, with these arrangement, both of the first and second embroidering machines 1 and 2 can be connected to the control unit 3 and driven under control at the same time, thereby improving productivity of the embroidery stitches.

While the invention has been described in several embodiments thereof, it is to be understood that this invention is not limited thereto and many modifications and variations may be made without departing from spirits and scope of the invention as defined in the appended claims. In the illustrated embodiments only two embroidering machines are employed, nevertheless, the number of embroidering machine connectable to a single control unit can be chooses upon necessity.

What is claimed is:

1. An embroidering system comprising:

(a) a plurality of embroidering machines having different operation modes, each having a vertically reciprocating needle carrying an upper thread, a loop taker means carrying a lower thread and operated in synchronism with the needle to interlock the upper thread with the lower thread to thereby form a stitch, and means for shifting a fabric in relation to the needle to thereby shift a needle dropping point on the fabric, each embroidering machine being operated under an operation mode unique thereto;

(b) a control unit, to which said embroidering machines are connectable by electric coupling means, adapted to control operation of said embroidering machines;

(c) each of said embroidering machines including signaling means comprising a resistor, each resistor having a different resistance value, for generating a signal representing the operation mode thereof when a respective embroidery machine is electrically connected to said control unit, and (d) said control unit including means to measure a voltage applied across said resistor in said signaling means provided for one of said embroidering machines which is electrically connected to said control unit to discriminate that said embroidering machine is electrically connected to said control unit, whereby said control unit is operated to control operation of said embroidering machine in such manner as to conform to the operation mode thereof.

2. The emboidering system according to claim 1 wherein said voltage measuring means is adapted to measure a voltage of a value determined by a voltage dividing ratio of said resistor and a reference resistor connected between a power supply and said voltage measuring means in said control unit.

* * * * *